US012723510B1

(12) United States Patent
Ali et al.

(10) Patent No.: US 12,723,510 B1
(45) Date of Patent: Sep. 1, 2026

(54) REAL-TIME MONITORING OF AN ELECTRONIC ASSEMBLY USING AN OPTICAL WAVEGUIDE

(71) Applicant: Schlumberger Technology Corporation, Sugar Land, TX (US)

(72) Inventors: Mahmoud Ali, Clamart (FR); Hocine Daou, Clamart (FR); Cleverson Souza Chaves, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/307,917

(22) Filed: Aug. 22, 2025

(51) Int. Cl.
*E21B 47/135* (2012.01)
*E21B 47/06* (2012.01)

(52) U.S. Cl.
CPC ..... *E21B 47/135* (2020.05); *E21B 47/06* (2013.01)

(58) Field of Classification Search
CPC ..... E21B 47/135; E21B 47/06; E21B 47/017; E21B 47/12
See application file for complete search history.

(56) References Cited

U.S. PATENT DOCUMENTS

| | | | | |
|---|---|---|---|---|
| 10,408,049 | B2 * | 9/2019 | Bhongale | H04B 10/63 |
| 11,469,823 | B2 * | 10/2022 | Purkis | H04B 10/43 |
| 2004/0129424 | A1 * | 7/2004 | Hosie | E21B 21/08 175/25 |
| 2018/0087375 | A1 * | 3/2018 | Segura Dominguez | H04J 14/02 |
| 2019/0195065 | A1 * | 6/2019 | Stark | G01V 11/002 |
| 2019/0242206 | A1 * | 8/2019 | McConnell | E21B 29/02 |
| 2022/0360356 | A1 * | 11/2022 | Lin | H04B 10/294 |
| 2022/0397429 | A1 * | 12/2022 | Burchard | G01D 5/145 |
| 2023/0235664 | A1 * | 7/2023 | Robutel | B81B 7/0058 73/152.54 |

FOREIGN PATENT DOCUMENTS

| | | | | |
|---|---|---|---|---|
| CN | 108612520 A | * 10/2018 | | E21B 47/12 |
| CN | 119062289 A | * 12/2024 | | E21B 47/13 |
| JP | 2024070192 A | * 5/2024 | | G06F 1/206 |
| WO | WO-2021137871 A1 | * 7/2021 | | G02B 6/122 |

OTHER PUBLICATIONS

Bamiedakis, N. et al., "PCB-Integrated Optical Waveguide Sensors: An Ammonia Gas Sensor", Journal of Lightwave Technology, 2013, 31(10), pp. 1628-1635.

Leite, T. M. et al., "Decoupling of Temperature and Strain Effects on Optical Fiber-Based Measurements of Thermomechanical Loaded Printed Circuit Board Assemblies", Sensors, 2023, 14 pages.

* cited by examiner

*Primary Examiner* — Daniel P Stephenson
(74) *Attorney, Agent, or Firm* — Kyle R. Miiller

(57) ABSTRACT

The present disclosure provides techniques and apparatus for real-time monitoring of an electronic assembly using an optical waveguide. An example electronic assembly includes at least one component, at least one optical waveguide and a controller. The controller is configured to determine one or more operating parameters of the at least one component via the optical waveguide. The controller may trigger one or more corrective actions based on the operating parameters.

16 Claims, 11 Drawing Sheets

REAL-TIME MONITORING OF AN ELECTRONIC ASSEMBLY USING AN OPTICAL WAVEGUIDE

BACKGROUND

Field of the Disclosure

The present disclosure relates to systems and methods for real-time monitoring of electronic assemblies in downhole environments using optical waveguides.

Description of Related Art

Electronic assemblies, such as printed circuit board (PCB) assemblies (PCBAs) and multi-chip modules (MCMs), as illustrative examples, are routinely exposed to harsh operating conditions (e.g., high temperatures, shock, vibration, etc.), particularity within the oil and gas industry. Such operating conditions contribute significantly to electronic assembly failures. For example, high temperatures, rapid temperature fluctuations, mechanical shock, persistent vibrations, or a combination thereof, can impact electronic assembly components in terms of performance degradation, thermal runaway, premature aging, physical damage, and complete functional failure, as illustrative examples. Additionally, in downhole applications, electronic assembly failures can lead to critical measurement inaccuracies and equipment control losses, resulting in substantial operational disruptions.

Existing techniques for mitigating potential electronic assembly thermal related failures generally involve monitoring the temperature and/or strain/deformation of the electronic assembly. Such techniques, for example, can be categorized into contact techniques and non-contact techniques. Contact techniques for measuring temperature generally involve using thermocouples, p-type n-type (PN) junctions, resistance temperature detectors (RTDs), or thermo-resistive sensors (also referred to as thermistors), among other devices, to measure the temperature, while non-contact techniques for measuring temperature generally involve using infrared cameras, liquid crystal thermography, or microwave imaging to measure the temperature. Contact techniques for measuring strain generally involve using strain gauges or linear variable differential transformers (LVDTs), extensometers to measure the strain or deformation, while non-contact techniques for measuring strain or deformation generally involve using digital image correlation to measure the strain.

Numerous challenges exist, however, with implementing contact and non-contact techniques to measure the temperature and strain/deformation of electronic assemblies in downhole environments. For example, implementing the aforementioned contact and non-contact techniques may be impractical and/or infeasible due in part to the limited space and harsh operating conditions in downhole environments.

SUMMARY

One embodiment of the present disclosure described herein is a method. The method includes monitoring operation of at least one electronic assembly comprising at least one component and at least one optical waveguide. The method also includes determining, via the optical waveguide, one or more operating parameters of the at least one component.

Another embodiment of the present disclosure described herein is an electronic assembly. The electronic assembly includes at least one component, at least one optical waveguide, and a controller. The controller is configured to determine, via the at least one optical waveguide, one or more operating parameters of the at least one component.

Another embodiment of the present disclosure described herein is a system. The system includes at least one electronic assembly and a controller. The at least one electronic assembly includes at least one component and at least one optical waveguide. The controller is configured to determine, via the at least one optical waveguide, one or more operating parameters of the at least one component.

The following description and the appended figures set forth certain features for purposes of illustration.

BRIEF DESCRIPTION OF DRAWINGS

Various embodiments in accordance with the present disclosure will be described with reference to the drawings, where like designations denote like elements. Note that the appended drawings illustrate typical embodiments and are therefore not to be considered limiting; other equally effective embodiments are contemplated.

DETAILED DESCRIPTION

Figure 1:
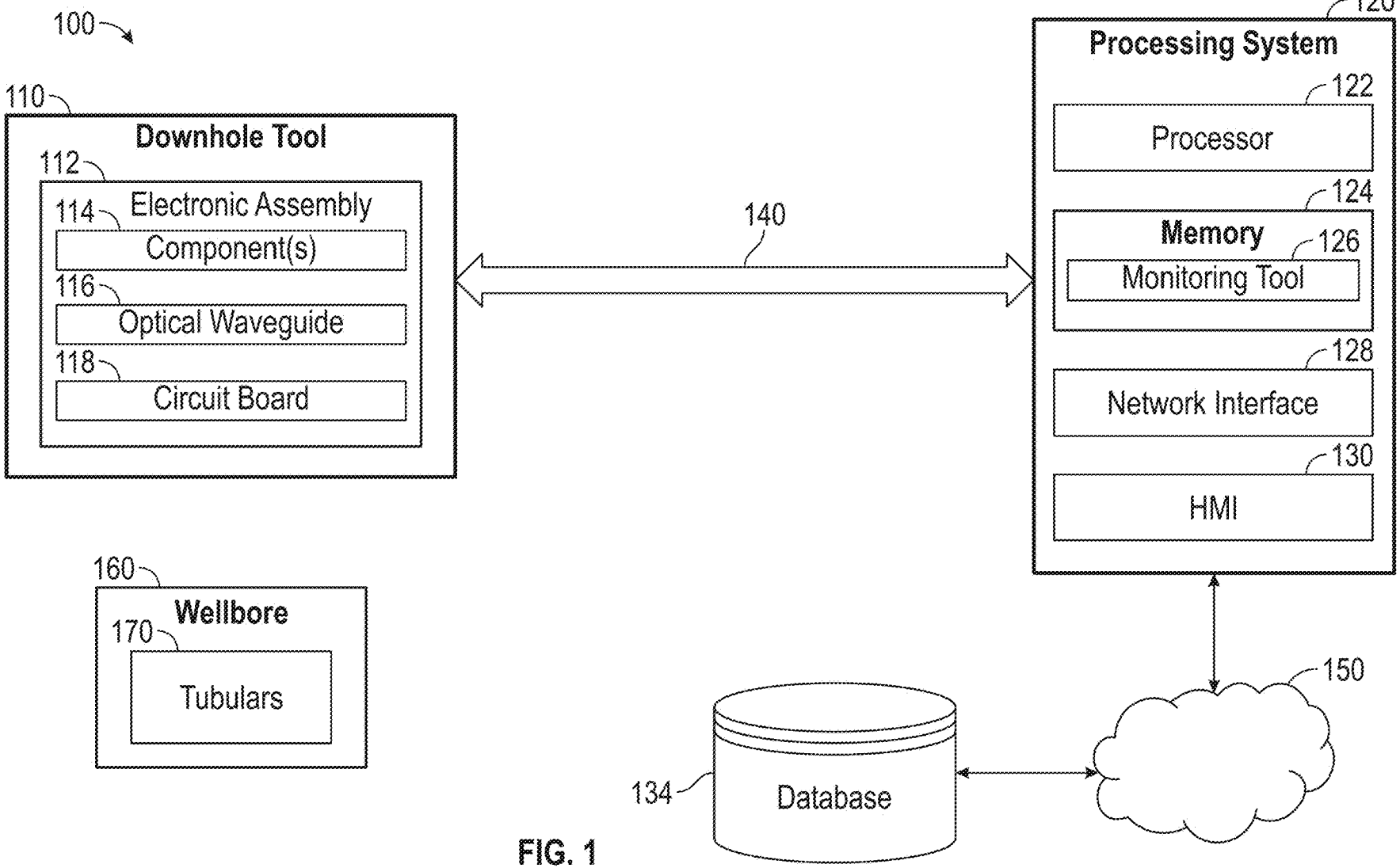
FIG. 1 is a schematic diagram of an example system, according to certain embodiments.

Electronic assemblies (e.g., PCBAs, MCMs, etc.) often face severe conditions, such as high temperatures, rapid temperature fluctuations, mechanical shock, and persistent vibrations, as illustrative examples, in downhole environments that can contribute significantly to the failure of electronic assemblies. Existing techniques for mitigating electronic assembly failures generally involve measuring the temperature and strain/deformation of electronic assemblies. Such techniques, however, are often impractical and/or infeasible to implement in downhole environments.

For example, contact-based temperature measurement techniques, including thermocouples, RTDs, and thermistors, involve direct attachment to the assembly surface. Thermocouples suffer from accuracy issues if improperly secured, in addition to fragile connections prone to damage. RTDs generally involve larger circuit board footprints and exhibit slow response times. Thermistors demonstrate limited detection ranges and necessitate compensation for nonlinear behavior. Moreover, contact-based temperature measurement that use digital integrated circuit (IC) temperature sensors typically measure temperatures at specific placement locations of the sensors, potentially missing nearby thermal hotspots. Additionally, digital solutions typically feature limited measurement bandwidths (e.g., less than 150 degrees Celsius (C)), susceptibility to electromagnetic interference (EMI), and have to use multiple ICs to achieve accurate average temperature measurements.

Additionally, non-contact based temperature measurement techniques, including infrared cameras, liquid crystal thermography, and microwave imaging can provide reliable spatial temperature distributions. However, these techniques generally rely on a substantial amount of space being available in order to provide accurate temperature measurements. Thus, implementing such non-contact based temperature measurement techniques is impractical in compact downhole tool configurations that experience constrained space conditions alongside extreme temperature, shock, and vibration.

Certain operators typically address the impracticalities of implementing contact and non-contact based temperature measurement techniques by estimating/average the temperature from other electric data. However, performing temperature measurement in this manner can lead to lack of real time monitoring of temperature and potential failures due to overheating of electronic assemblies. In addition, temperature measurements are performed at a limited number of points.

Furthermore, strain and deformation measurement techniques face similar challenges. For example, contact-based strain/deformation measurement techniques, such as strain gauges and LVDTs, and non-contact based strain/deformation measurement techniques, such as digital image correlation, each possess inherent issues similar to temperature measurement techniques. Moreover, existing strain and deformation measurement techniques generally do not perform direct strain/deformation measurements on PCBs or MCMs, thereby omitting critical (real-time) information on mechanical deformation within these assemblies that can lead to failure of electronic assemblies.

The disclosure provides techniques, methods, systems, apparatus, and computer-readable media for real-time monitoring of electronic assemblies in downhole environments using optical waveguides. For example, the disclosure provides techniques for determining operating parameters (e.g., temperature, strain, deformation, etc.) of one or more components of an electronic assembly associated with a downhole tool using an optical waveguide in the electronic assembly. Such components may include ICs, passive electronic components, active electronic components, connectors, interconnects (e.g., solder joints, traces, vias), or any combination thereof.

As described in greater detail herein, certain embodiments leverage an optical waveguide, such as an optical fiber, polymer waveguide in substrates, and photonic integrated circuits (PICs), to measure temperature and strain (and/or deformation) in electronic assemblies in real-time. The optical waveguide may be disposed across any suitable locations in the electronic assembly and/or have any suitable placement configuration or pattern to enable accurate measurement of temperature and strain/deformation at multiple points (e.g., places or positions) across the electronic assembly. For example, in certain embodiments, the optical waveguide may be disposed on a surface of a circuit board (e.g., printed circuit board) of the electronic assembly. In other embodiments, the optical waveguide may be embedded within layers of the (circuit board of the) electronic assembly.

Additionally, certain embodiments described herein perform real-time monitoring to determine whether to trigger certain corrective actions to prevent temperature and/or deformation related failures in downhole electronic assemblies. For example, in certain embodiments, the real-time measurements (obtained via the optical waveguide) are continuously compared to one or more thresholds (e.g., reference safe values). If the system described herein detects that a real-time measurement satisfies a given threshold, then the system may trigger an automated corrective action to prevent the temperature and/or deformation related failure in the downhole electronic assembly.

The techniques, methods, systems, apparatus, and computer readable media for real-time monitoring of electronic assemblies in downhole environments using optical waveguides may provide various technical advantages. For example, with conventional temperature measurement techniques, the real-time optical waveguide-based monitoring techniques described herein can be implemented in downhole environments where there is limited space at the electronic assembly and the electronic assembly is subjected to severe operating conditions. Additionally, as noted, using optical waveguides allows for real-time measurement of temperature/deformation at any number of points in the electronic assembly, rather than solely at sensor placement locations within the electronic assembly. That is, techniques described herein can determine accurate measurements of temperature and deformation at particular locations of interest (e.g., where particular components are located), notwithstanding whether an IC temperature sensor is disposed at the location.

Additionally, the real-time optical waveguide-based monitoring techniques described herein allow for preventing (or at least reducing a likelihood of) temperature and/or deformation related failures of electronic assemblies in downhole environments. For example, embodiments can trigger corrective actions whenever a real-time measurement satisfies a given threshold to prevent (or at least reduce the likelihood) of a temperature and/or deformation related failure of an electronic assembly. As an illustrative example, a corrective action triggered in response to a real-time temperature measurement of a component in an electronic assembly may include decreasing the power dissipation of the electronic assembly (and/or the component thereof), allowing the electronic assembly (and/or the component thereof) to cool down to a desired temperature.

While various embodiments described herein use downhole environments as an illustrative example environment in which the techniques described herein can be implemented, it should be noted that the techniques described herein for monitoring electronic assemblies using optical waveguides can be used in other environments, including, for example, surface environments, subsea environments, among others.

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

Although the terms "first," "second," "third," etc., may be used herein to describe various elements, components, regions, layers and/or sections, these elements, components, regions, layers and/or sections should not be limited by these terms. These terms may be only used to distinguish one element, component, region, layer or section from another element, component, region, layer, or section. Terms such as "first," "second," and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

As used herein, a hyphenated form of a reference numeral refers to a specific instance of an element and the unhyphenated form of the reference numeral refers to the collective element. Thus, for example, device "12-1" refers to an instance of a device class, which may be referred to collectively as devices "12" and any one of which may be referred to generically as a device "12".

Example System for Real-Time Monitoring of an Electronic Assembly Using an Optical Waveguide FIG. 1 is a block diagram of at least a portion of an example implementation of a system 100 for performing real-time monitoring of an electronic assembly using an optical waveguide, according to certain embodiments. In certain embodiments, the system 100 is located in a land-based operating environment (e.g., onshore). In other embodiments, the system 100 is located in a water-based operating environment (e.g., offshore).

As shown, the system 100 includes, without limitation, a processing system 120, a database 134, a downhole tool 110, and a wellbore 160. The processing system 120 and the database 134 may be interconnected via a network 150. The network 150 is representative of a variety of networks, such as a personal area network (PAN) (e.g., a Bluetooth network), a local area network (LAN) (e.g., 802.11 or WiFi network), and a wide area network (WAN) (e.g., cellular network), as illustrative examples.

The processing system 120 is generally representative of a variety of computing systems, such as laptops, servers, desktops, and mainframes, as illustrative examples. In certain embodiments, the processing system 120 (including one or more components therein) is located in (or otherwise accessible via) a cloud computing environment. The processing system 120 may be implemented using hardware, software, or a combination of hardware and software.

The database 134 is generally representative of one or more storage systems configured to store information associated with real-time monitoring of electronic assemblies. For example, the database 134 may store real-time operating parameters (e.g., temperature and/or strain/deformation measurements) obtained via the downhole tool 110. The database 134 may be implemented using hardware, software, or a combination of hardware and software. In certain embodiments, the database 134 is located in (or otherwise accessible via) a cloud computing environment.

In the depicted system, the wellbore (or borehole) 160 is drilled in a subsurface formation(s). As noted, the subsurface formation(s) can be located onshore or offshore. The downhole tool 110 (also referred to herein as a tool string) may be lowered into the wellbore 160. The wellbore 160 may include one or more tubulars 170, which represent lengths of pipe including threads and/or other means for connecting each end to threads and/or other connection means of a tubular.

The downhole tool 110 may be controlled to measure and/or generate data including measurements of operating parameters (or conditions) (e.g., temperature and/or strain/deformation measurements) associated with the wellbore 160 (including tubulars 170) and/or components of the downhole tool 110 operating in the wellbore 160, as further described herein. In certain cases, the downhole tool 110 may be communicatively coupled to the processing system 120 via a cable 140. The cable 140 may include one or more mechanical cables, electrical cables, and/or electro-optical cables that include one or more fiber-optic lines. Data (e.g., operating parameters) related to the wellbore 160 (including tubulars 170) and/or components of the downhole tool 110 operating in the wellbore 160 gathered by the downhole tool 110 may be transmitted to the processing system 120 (via the cable 140) and/or stored in the database 134 for later processing and analysis.

In certain embodiments, the downhole tool 110 includes one or more electronic assemblies 112. Although a single electronic assembly 112 is depicted for the sake of clarity, it should be noted that the downhole tool 110 may include more than one electronic assembly 112. The electronic assembly 112 is representative of a variety of electronic assemblies, including PCBAs and MCMs, as illustrative examples. A PCBA generally refers to a completed printed circuit board (PCB) (also referred to as a printed wiring board (PWB)) with components (e.g., resistors, capacitors, transistors, ICs, and other electronic components) mounted and soldered thereon. A MCM generally refers to a specialized package that integrates multiple chips onto a single substrate.

In the depicted embodiment, the electronic assembly 112 includes one or more components 114, an optical waveguide 116, and a circuit board 118. The circuit board 118 is generally representative of a printed circuit board (PCB) (also referred to as a PWB). In certain embodiments, the circuit board 118 includes (or is composed of) multiple layers, including substrate layers, conductive (or electrical) layers (e.g., copper layers), insulating layers, optical layers, or a combination thereof. The component(s) 114 may include ICs, passive electronic components (e.g., resistors, capacitors, inductors, etc.), active electronic components (e.g., transistors, diodes, voltage/current sources, etc.), connectors (e.g., board-to-board connectors, wire-to-board connectors, input/output (I/O) and data interface connectors, power connectors, etc.), interconnects (e.g., solder joints, traces, vias), or any combination thereof. The component(s) 114 may be disposed on a (top and/or bottom) surface of the circuit board 118 and/or in layer(s) of the circuit board 118.

The optical waveguide 116 is representative of a variety of optical waveguides, including optical fibers, polymer waveguides, and PICs, as illustrative examples. As described further herein, the optical waveguide 116 may be disposed across any suitable locations in the electronic assembly 112 and/or have any suitable placement configuration or pattern to enable accurate measurement of temperature and/or strain/deformation at multiple points across the electronic assembly 112. In certain embodiments, the optical waveguide 116 is used to measure temperature and/or strain/deformation at one or more points across the electronic assembly 112. As described in greater detail herein, in certain embodiments, the optical waveguide 116 is disposed on a surface of the circuit board 118. In other embodiments, the optical waveguide 116 is embedded within one of the substrate layers of the circuit board 118.

As shown, the processing system 120 includes, without limitation, a processor 122, a memory 124, a network interface 128, and a human machine interface (HMI) 130. The processor 122 represents any number of processing elements, which can include any number of processing cores. The memory 124 can include volatile memory, non-volatile memory, and combinations thereof. The memory 124 generally includes program code (e.g., monitoring tool 126) for performing various techniques described herein. The program code is generally described as various functional "components" or "modules" within the memory 124, although alternate implementations may have different functions or combinations of functions. Although FIG. 1 depicts the monitoring tool 126 being implemented within the processing system 120, in certain embodiments, the monitoring tool 126 may be implemented within the electronic assembly 112. For example, the electronic assembly 112 may include a controller that implements the monitoring tool 126.

The network interface 128 may include circuitry for communicating over the network 150. For example, the network interface 128 may include interfaces for PAN, LAN, and/or WAN, as illustrative examples. The HMI 130 may include one or more input and/or output devices for enabling communication between the processor 122, the memory 124, the network interface 128, and one or more users. In certain embodiments, the HMI 130 includes one or more input devices, one or more output devices, or a combination thereof. For example, the HMI 130 may include a display and/or a keyboard, a mouse, a touch pad, or other input devices suitable for receiving inputs from a user. In certain embodiments, the HMI 130 includes a touch-screen display (e.g., touch screen liquid crystal display (LCD)), which may enable users to interact with a user interface of the processing system 120.

The processing system 120 may obtain the measurements from the downhole tool 110 as raw data. In certain embodiments, the measurements are processed or pre-processed by the downhole tool 110 before being sent to the processing system 120. The processing system 120 may process (via the monitoring tool 126) the measurements to determine corresponding operating parameters associated with components 114 of the electronic assembly 112. Such operating parameters may include thermal parameters (e.g., temperature), mechanical parameters (e.g., strain, deformation, etc.), or a combination thereof. In certain cases, assuming the measurement(s) is taken at a point in the electronic assembly 112 where a given component 114 is located, the processing system 120 may use the measurement(s) as the operating parameter(s) for the component 114. In other cases, however, the measurement(s) may be taken at a point in the electronic assembly 112 that is different from the location of the component 114. In such case, the processing system 120 may use a model (e.g., calibration model) to translate the measurement at the given point in the electronic assembly 112 to a corresponding operating parameter for the component 114 in the electronic assembly 112. The processing system 120 may store the operating parameter(s) in the database 134.

Additionally or alternatively, the processing system 120 (via the monitoring tool 126) may trigger one or more corrective actions, based on the operating parameters that are determined from the measurements obtained via the downhole tool 110. For example, when the processing system 120 determines that an operating parameter for a component 114 satisfies a threshold, the processing system may control operation of the component 114 and/or electronic assembly 112 according to a corrective action to prevent (or at least reduce a likelihood of) failure of the component 114 and/or electronic assembly 112.

Additionally or alternatively, although not shown, the processing system 120 may include one or more artificial intelligence (AI)/machine learning (ML) models trained to predict failures of electronic assemblies. Such AI/ML models may be trained on data within the database 134 and/or otherwise obtained via the network 150. In certain embodiments, the trained AI/ML models may be used to anticipate failures, design electronic assemblies and/or enhance production quality of tools less sensitive to extreme temperatures and/or strain/deformation.

Figure 2:
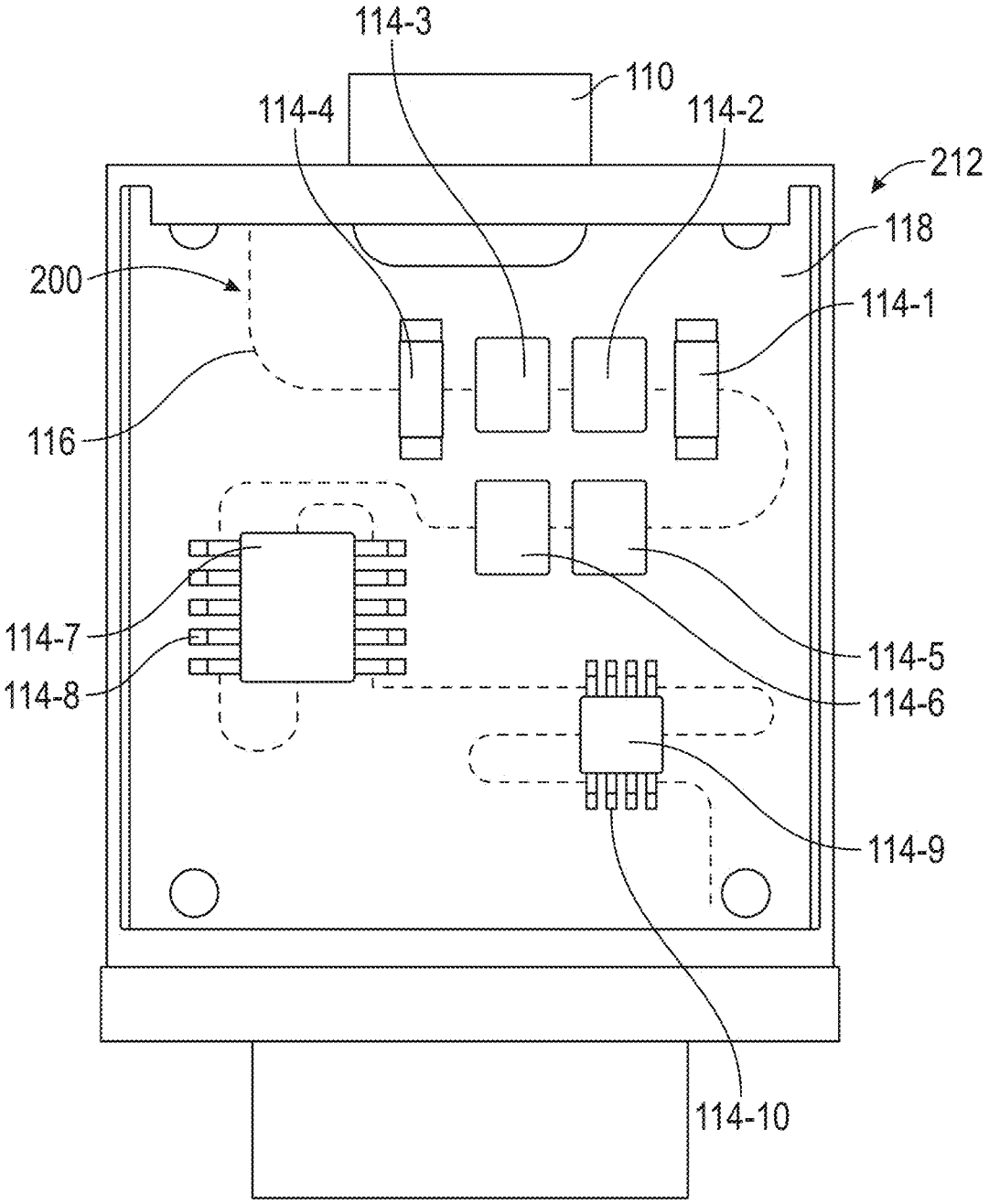
FIG. 2 illustrates an optical waveguide configuration for an electronic assembly, according to certain embodiments.

As noted, the optical waveguide 116 may be disposed in various locations in the electronic assembly 112 and/or have any suitable placement configuration or pattern in the electronic assembly 112. FIG. 2 illustrates an optical waveguide configuration 200 for an electronic assembly 212 of a downhole tool 110, according to certain embodiments. The electronic assembly 212 is an illustrative implementation of the electronic assembly 112 illustrated in FIG. 1.

The electronic assembly 212 includes multiple components 114-1 to 114-10 disposed in different locations on the circuit board 118. The components 114-1 to 114-6 may be representative of passive electronic components, the components 114-7 and 114-9 may be representative of ICs, and the components 114-8 and 114-10 may be representative of interconnects (e.g., solder joints). In the optical waveguide configuration 200, the optical waveguide 116 is routed across the electronic assembly 212, such that the optical waveguide 116 covers multiple points of the electronic assembly 212 including points where the components 114-1 to 114-10 are located. Note that the pattern of the optical waveguide configuration 200 illustrated in FIG. 2 is an illustrative example of a pattern that can be used for routing an optical waveguide in an electronic assembly and that the optical waveguide can be routed according to other patterns/arrangements.

Figure 3A:
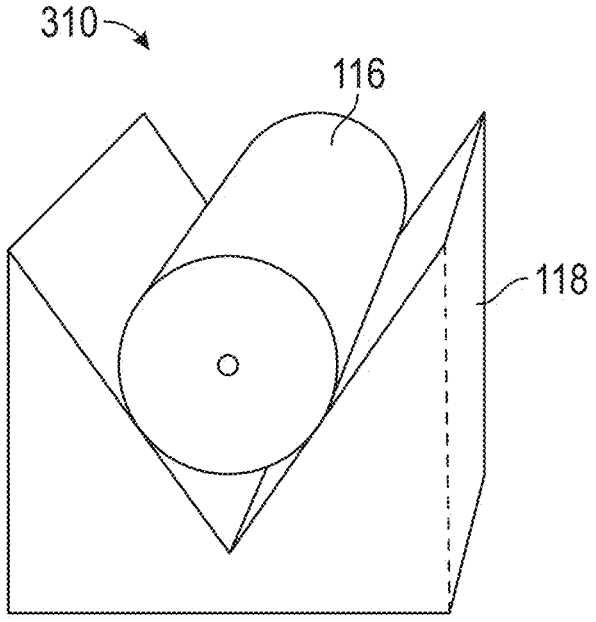
FIGS. 3A and 3B illustrate examples of optical waveguides in different grooves of a circuit board, according to certain embodiments.
Figure 3B:
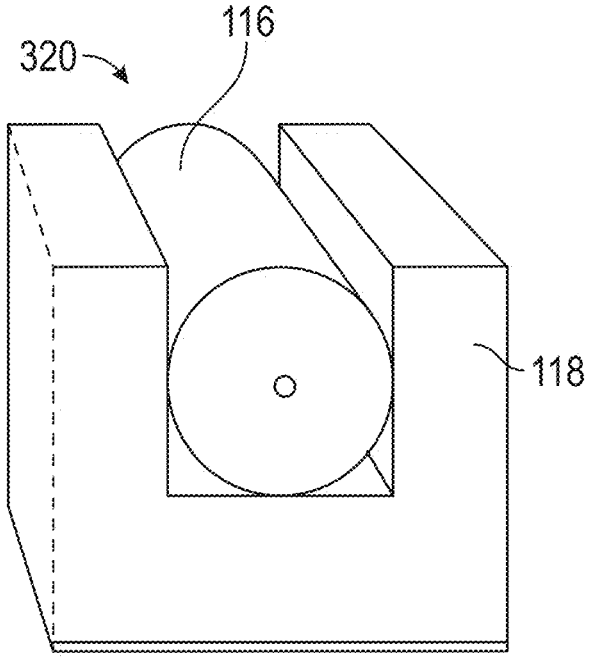

In certain embodiments, the optical waveguide 116 of the optical waveguide configuration 200 is disposed on a surface of the circuit board 118. In some such embodiments, the optical waveguide 116 is disposed (e.g., fixed and routed) in grooves on a surface of the circuit board 118. The grooves may have any suitable configuration, including "V" grooves and "U" grooves, as illustrative examples. FIG. 3A depicts an example of an optical waveguide 116 disposed in a "V" groove 310 of a surface of a substrate (e.g., circuit board 118) and FIG. 3B depicts an example of an optical waveguide 116 disposed in a "U" groove 320 of a surface of a substrate, according to certain embodiments.

Figure 4:
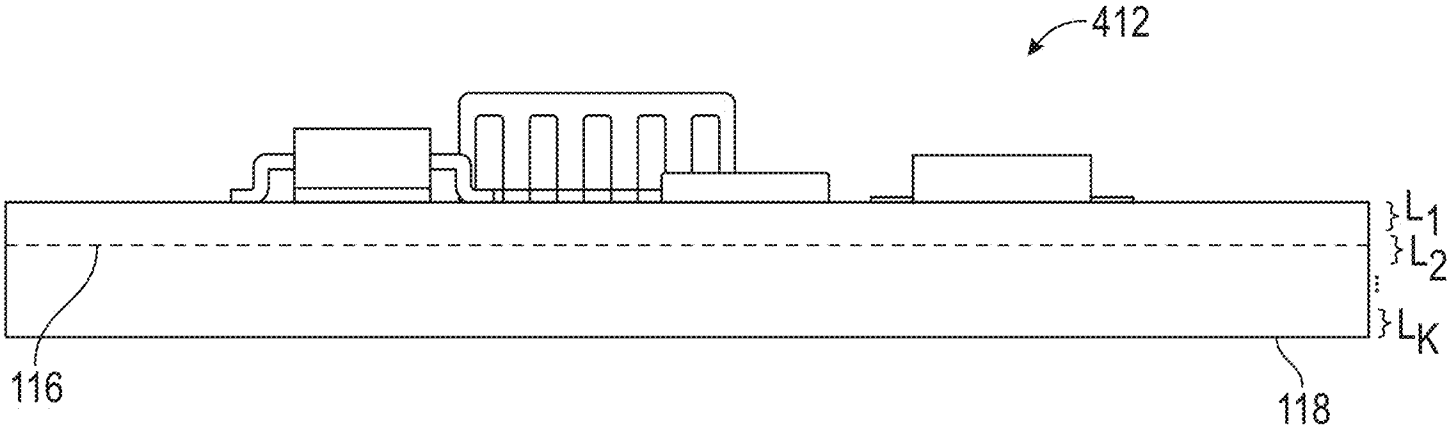
FIG. 4 illustrates a cross-section view of an electronic assembly, according to certain embodiments.

In certain embodiments, the optical waveguide 116 of the optical waveguide configuration 200 is disposed in one or more layers of the circuit board 118. For example, the optical waveguide 116 can be embedded in the stack-up (or layer stack-up) of the circuit board 118. For example, the optical waveguide 116 may be inserted in a middle layer (or another layer) of the stack-up of the circuit board 118. As noted, the stack-up of the circuit board 118 may include conductive layers (e.g., copper layers), insulating layers (e.g., dielectric layers), optical layers, or a combination thereof. By way of example, FIG. 4 depicts a cross-section view of an electronic assembly 412 having an optical waveguide 116 disposed in the stack-up of the circuit board 118, which includes multiple layers $L_1$ to $L_N$. Note, the electronic assembly 412 is an illustrative implementation of the electronic assembly 112 illustrated in FIG. 1 or the electronic assembly 212 illustrated in FIG. 2. As shown in FIG. 4, the optical waveguide 116 is disposed in layer $L_2$ of the circuit board 118. The layer $L_2$ may be a conductive layer, an insulating layer, or an optical layer.

In certain embodiments, the optical waveguide 116 of the optical waveguide configuration 200 uses the substrate itself as the optical waveguide, referred to herein as a "substrate optical waveguide" or a "polymer waveguide." In some such embodiments, the substrate optical waveguide is configured by embedding the optical layer in the circuit board 118 along with conductive layers. By using a substrate optical waveguide as the optical waveguide 116, embodiments herein can avoid using onboard interconnects, thereby increasing the packaging density.

Figure 5:
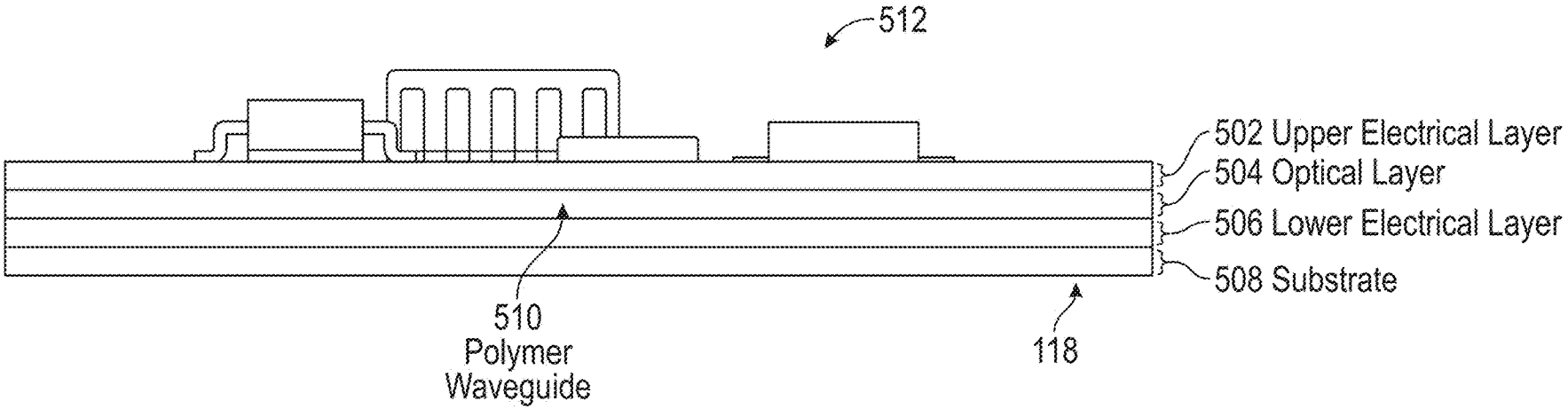
FIG. 5 illustrates a cross-section view of another electronic assembly, according to certain embodiments.

FIG. 5 depicts a cross-section view of an electronic assembly 512 having an optical waveguide 116 configured as a substrate optical waveguide, according to certain embodiments. Note, the electronic assembly 512 is an illustrative implementation of the electronic assembly 112 illustrated in FIG. 1, the electronic assembly 212 illustrated in FIG. 2, or the electronic assembly 412 illustrated in FIG. 4. As shown in FIG. 5, the circuit board 118 includes an upper electrical layer 502, an optical layer 504, a lower electrical layer 506, and a substrate 508.

In the depicted embodiment, the optical layer 504 includes a polymer waveguide 510. In certain cases, the polymer waveguide 510 may be formed from glass or optical polymers within the optical layer 504. Additionally or alternatively, the polymer waveguide 510 may be formed using additive manufacturing (e.g., via an inkjet-printed method). Note, the polymer waveguide 510 is an illustrative implementation of the optical waveguide 116 illustrated in FIG. 1. In certain cases, the polymer waveguide 510 can be complemented with low loss optical coupling to form optical links with the use of a dual lens system or the embedding of parabolic mirrors.

Figure 6:
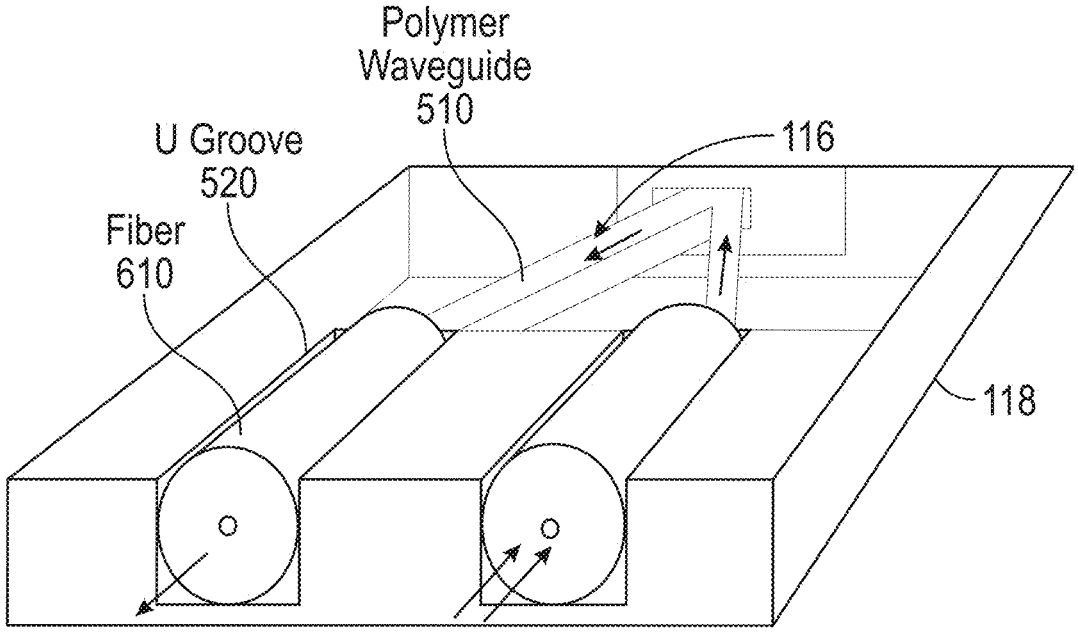
FIG. 6 illustrates an example optical waveguide having a portion disposed in a groove and another portion disposed in a layer of a circuit board, according to certain embodiments.

Note that while FIGS. 3A-3B, 4, and 5 depict different implementations of the optical waveguide 116, the optical waveguide 116 described herein can be implemented using any combination of the implementations depicted in FIGS. 3A-3B, 4, and 5. By way of example, FIG. 6 depicts an optical waveguide 116 having a portion (e.g., optical fiber 610) disposed in a U groove 520 of a surface of the circuit board 118 and having another portion (e.g., polymer waveguide 510) disposed in a layer (e.g., optical layer) of the circuit board 118.

Figure 7:
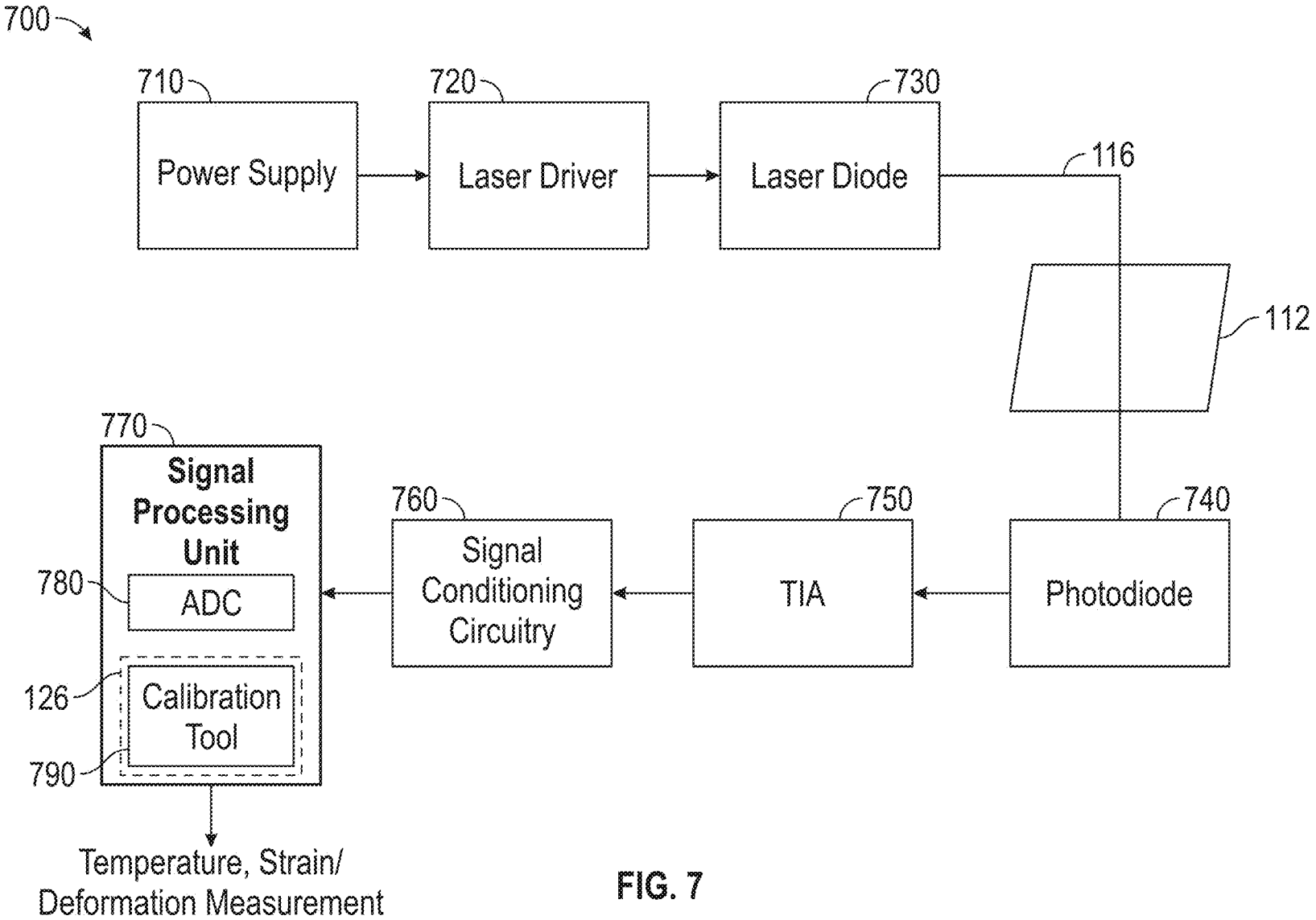
FIG. 7 illustrates a block diagram of at least a portion of an example system for performing intensity-based optical sensing, according to certain embodiments.

Referring back to FIG. 1, in certain embodiments, the processing system 120 (via the monitoring tool 126) is configured to perform temperature and/or strain/deformation measurements in the wellbore 160 via the optical waveguide 116 using an intensity-based optical sensing technique. FIG. 7 is a block diagram of at least a portion of an example system 700 for performing intensity-based optical sensing, according to certain embodiments. The system 700 may be an illustrative implementation of the system 100 depicted in FIG. 1.

As shown, the system 700 includes, without limitation, a power supply 710, a laser driver 720, a laser diode 730, a photodiode 740, a transimpedance amplifier (TIA) 750, signal conditioning circuitry 760, and a controller 770 (e.g., microcontroller unit (MCU), field programmable gate array (FPGA), among other ICs). The power supply 710 may drive the laser driver 720, which supplies (drives) constant current to the laser diode 730 in order to provide a stable light source for the optical fiber sensors (e.g., optical waveguide 116). Changes in temperature and/or mechanical strain affect the intensity of light transmitted through the optical waveguide 116. The photodiode 740 detects this varying intensity and generates a current proportional to the varying intensity. This current is converted to voltage using the TIA 750 and conditioned via the signal conditioning circuitry 760. For example, the signal conditioning circuitry 760 may filter the analog signal to remove high frequency noise. The filtered analog signal is then provided to the controller 770 for further processing.

As shown, the controller 770 includes an analog-to-digital converter (ADC) 780 and a calibration tool 790. The calibration tool 790 may be implemented as part of the monitoring tool 126 illustrated in FIG. 1. The controller 770 may digitize the filtered analog signal using the ADC 780 and compute a corresponding temperature and/or strain/deformation measurement, based on the digital signal, using the calibration tool 790.

Referring back to FIG. 1, in certain embodiments, the optical waveguide 116 is implemented using a PIC. In some such embodiments, the PIC may be disposed in various locations of the electronic assembly 112, including on a surface of the circuit board 118 or embedded within layer(s) of the circuit board 118. The PIC can be built on a silicon nitride (SiN) integrated photonics platform, an indium phosphide (InP) integrated photonics platform, or a silicon (Si) integrated photonics platform. Using a PIC as the optical waveguide 116 may introduce lower losses compared to optical fiber-based implementations, allowing for more complex integrated circuits. Additionally, PIC-based optical waveguides may have a low light absorption that offers an improved thermal stability, enabling the PIC to handle significantly higher power than other conventional techniques.

Figure 8:
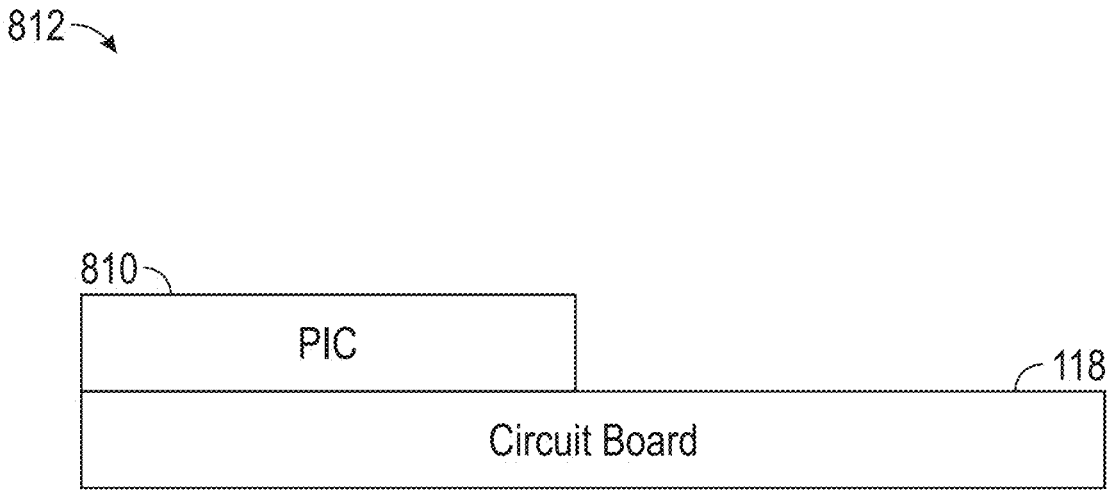
FIG. 8 illustrates a cross-section view of another electronic assembly, according to certain embodiments.

FIG. 8 depicts a cross-section view of an electronic assembly 812 including a PIC 810 disposed on a top surface of a circuit board 118, according to certain embodiments. The electronic assembly 812 is an illustrative implementation of the electronic assembly 112 illustrated in FIG. 1, and the PIC 810 is an illustrative implementation of the optical waveguide 116 illustrated in FIG. 1. Note that while FIG. 8 depicts the PIC 810 being disposed on the top surface of the circuit board 118, in other embodiments, the PIC 810 may be disposed on a bottom surface of the circuit board 118.

Figure 9:
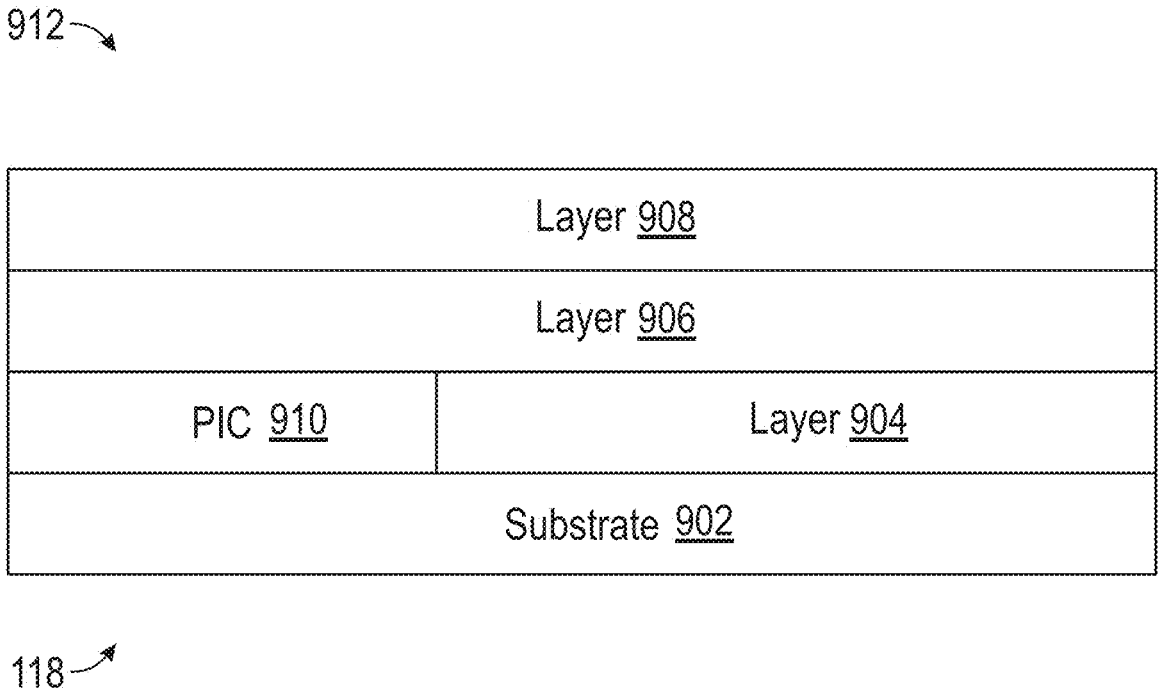
FIG. 9 illustrates a cross-section view of another electronic assembly, according to certain embodiments.

FIG. 9 depicts a cross-section view of an electronic assembly 912 including a PIC 910 disposed in layer(s) of a circuit board 118, according to certain embodiments. The electronic assembly 912 is an illustrative implementation of the electronic assembly 112 illustrated in FIG. 1, and the PIC 910 is an illustrative implementation of the optical waveguide 116 illustrated in FIG. 1. Here, the circuit board 118 includes a substrate 902 and layers 904, 906, and 908. Each of the layers 904, 906, and 908 may be an electrical layer, insulating layer, or optical layer. The PIC 910 is disposed between the substrate 902 and the layer 906.

In certain embodiments, the electronic assembly 112 illustrated in FIG. 1 may include an integration of PICs and optical waveguides. In some such embodiments, the PICs may replace optical sensitive elements (e.g., photodiodes, lasers, and light emitting diodes (LEDs)) using active InP or another direct-bandgap platform component. Additionally, the platform may utilize SiN as a passive optical waveguide, forming a heterogeneous integration.

Referring back to FIG. 1, in certain embodiments, the processing system 120 (via the monitoring tool 126) is configured to perform temperature and/or strain/deformation measurements in the wellbore 160 via the optical waveguide 116 using a PIC-based optical sensing technique. PIC-based optical sensing generally involves detecting temperature and/or strain/deformation through wavelength shifts as opposed to intensity variation. In such embodiments, the optical waveguide 116 may be implemented using a PIC, such as PIC 810 or PIC 910. For example, in PIC-based optical sensing, the PIC may include resonant photonic structures (e.g., ring resonators, Bragg gratings). In some cases, SiN waveguides may also be used for low-loss, high-temperature operation.

Figure 10:
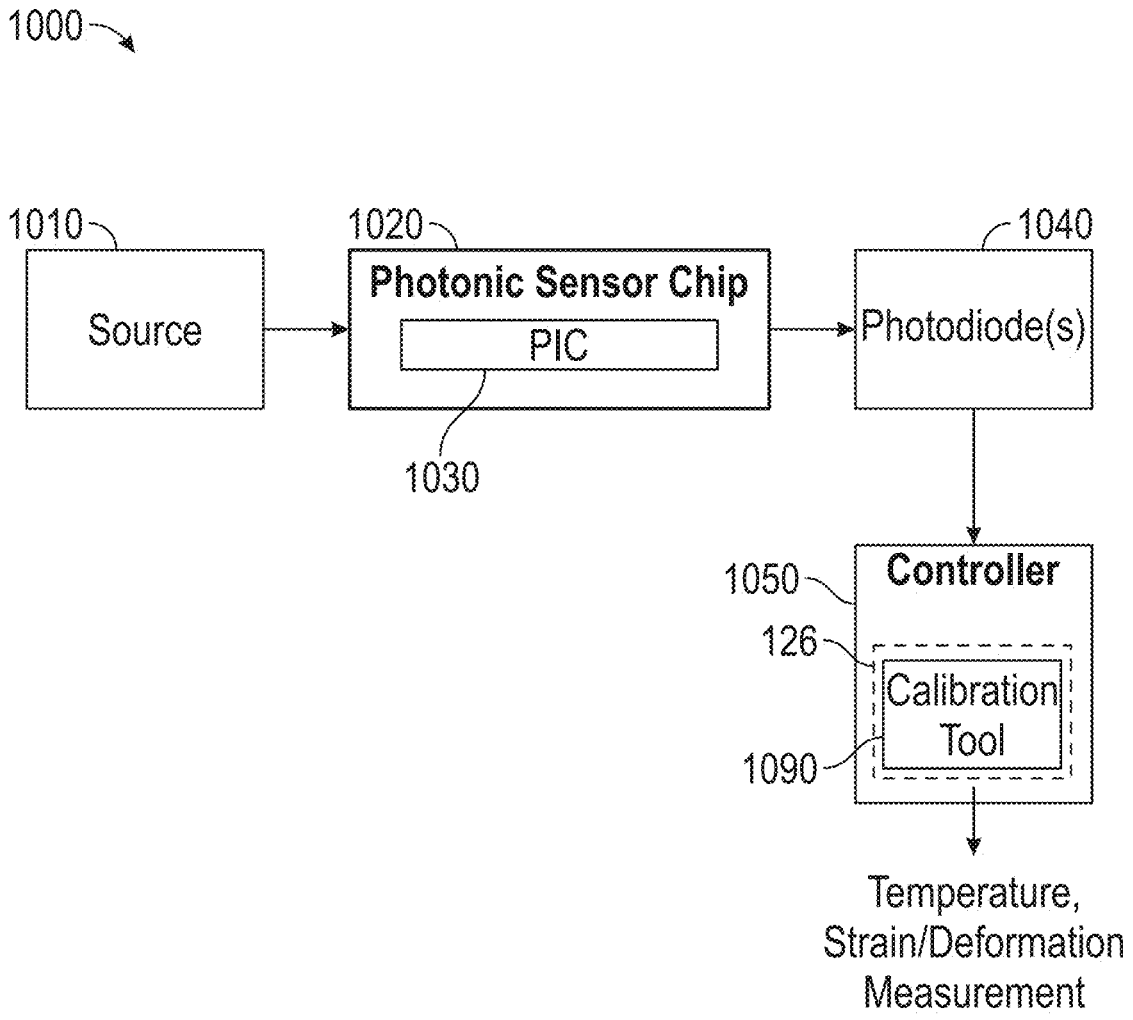
FIG. 10 illustrates a block diagram of at least a portion of an example system for performing photonic integrated circuit (PIC)-based optical sensing, according to certain embodiments.

FIG. 10 is a block diagram of at least a portion of an example system 1000 for performing PIC-based optical sensing, according to certain embodiments. The system 1000 may be an illustrative implementation of the system 100 depicted in FIG. 1. As shown, the system 1000 includes, without limitation, a source 1010, a photonic sensor chip 1020, one or more photodiodes 1040, and a controller 1050 (e.g., MCU, FPGA, among other ICs).

The source 1010 is generally representative of a tunable laser or broadband source. The source injects light into the photonic sensor chip 1020, which includes a PIC 1030. The PIC 1030 is an illustrative implementation of the PIC 810 illustrated in FIG. 8 or the PIC 910 illustrated in FIG. 9. In certain embodiments, the PIC 1030 includes one or more integrated resonators. When light is injected into the PIC 1030, changes in temperature or strain causes a shift in the resonance wavelength of the optical structure (e.g., resonators, Bragg gratings, etc.). These shifts may appear as spectral dips or peaks in the transmitted signal and may be detected by the photodiode(s) 1040. Note, the photodiode(s) 1040 may be implemented on-chip or as discrete photodiode(s). The output from the photodiode(s) 1040 is sent to the controller 1050 for further processing.

As shown, the controller 1050 includes a calibration tool 1090, which may be implemented as part of the monitoring tool 126 illustrated in FIG. 1. The controller 1050 may compute, via the calibration tool 1090, a temperature measurement using a calibrated wavelength-to-temperature mapping and/or a strain/deformation measurement using a calibrated strain/deformation-to-temperature mapping.

Figure 11:
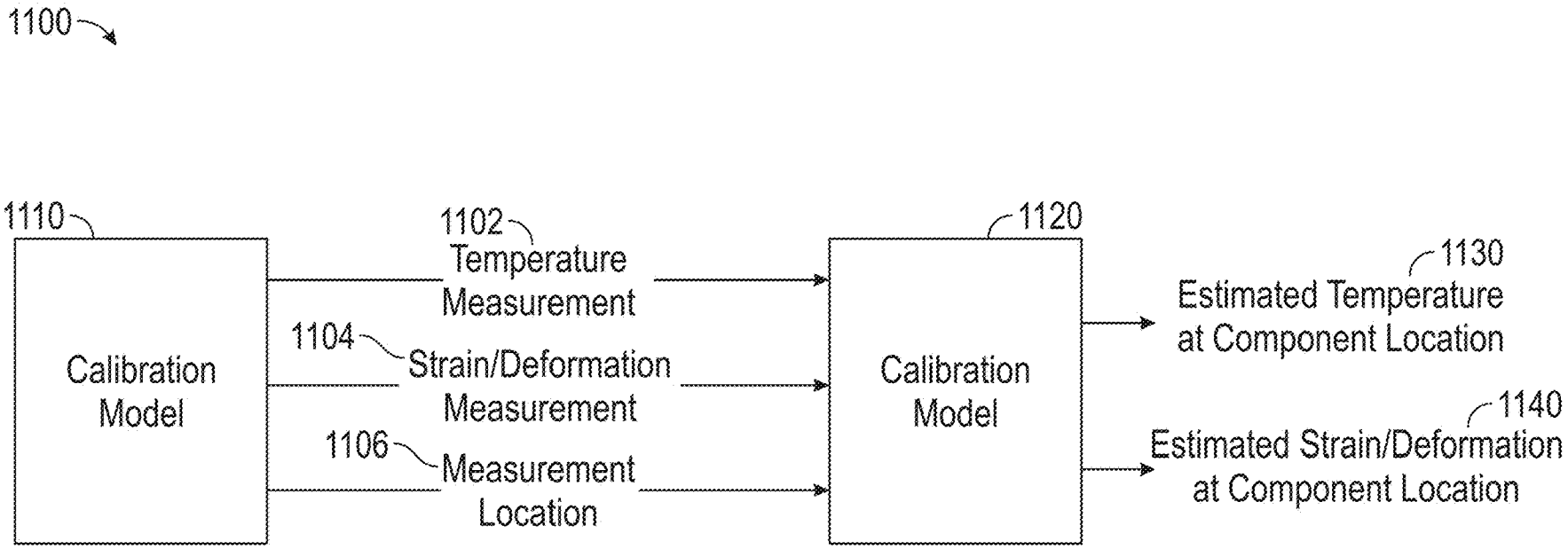
FIG. 11 illustrates a workflow for determining operating parameters of an electronic assembly, according to certain embodiments.

FIG. 11 is a block diagram of an example workflow 1100 for determining operating parameters (e.g., temperature, strain/deformation) of a component (e.g., component 114) of an electronic assembly 112 in a downhole environment (e.g., wellbore 160), according to certain embodiments. The workflow 1100 may be implemented by the system 100 (including one or more components thereof). In certain embodiments, the workflow 1100 is implemented by a calibration tool, such as the calibration tool 790 illustrated in FIG. 7 or the calibration tool 1090 illustrated in FIG. 10.

As illustrated in FIG. 11, a calibration model 1110 may determine a temperature measurement 1102 and/or a strain/deformation measurement 1104 via an optical waveguide 116 of the electronic assembly 112. In certain embodiments, the temperature measurement 1102 and/or the strain/deformation measurement 1104 may be determined for a given measurement location 1106 along the optical waveguide 116. In certain embodiments, the calibration model 1110 determines the temperature measurement 1102 and/or the strain/deformation measurement 1104 using a set of reference temperature and strain/deformation measurements associated with the optical waveguide 116.

For example, initial measurements (e.g., Rayleigh scatter) of the optical waveguide 116 may be performed when the optical waveguide 116 is at an ambient/stable state (e.g., prior to deployment in a downhole environment). These initial measurements may be stored (e.g., in database 134) as the reference temperature and strain/deformation measurements for the optical waveguide 116.

Subsequently, when a temperature and/or strain/deformation measurement is conducted via the optical waveguide 116 in a downhole environment, the scatter profile may be measured with strain or a temperature change applied at some point along the length of the optical waveguide 116. The calibration model 1110 may correlate the scatter profiles from the two datasets along the length of the optical waveguide 116 to determine the spectral shift of the scattered light as a result of the applied temperature or strain.

By way of example, a change in temperature or in strain from the reference state may result in a shift in the spectrum of light scattered in the optical waveguide 116. This shift in the spectrum in response to strain, $\varepsilon$, or temperature, T, is analogous to a shift in the resonance wavelength, $\Delta\lambda$, or the spectral shift, $\Delta\upsilon$, of a Bragg grating, as shown below:

$$\frac{\Delta\lambda}{\lambda} = \frac{\Delta\upsilon}{\upsilon} = K_T T + K_\varepsilon \varepsilon \tag{1}$$

where $\lambda$ and $\upsilon$ are the mean optical wavelength and frequency, respectively, and $K_T$ and $K_\varepsilon$ are the temperature and strain calibration constants, respectively. The values for $K_T$ and $K_\varepsilon$ may be based on a type of material of the optical waveguide 116.

In certain cases, if the optical waveguide 116 undergoes a change in strain or temperature, the reflection spectrum at that location in the optical waveguide 116 may experience a shift in optical frequency Av and can be denoted as $Y_j(\upsilon-\upsilon_j)$. The calibration model 1110 may compute the shift in the reflection spectrum Au; by performing a cross correlation operation on $Y_j(\upsilon)$ and $Y_j(\upsilon-\upsilon_j)$. The calibration model 1110 may then relate this spectral shift to a temperature or strain change using Equation (1).

In certain cases, the measurement location 1106 in the optical waveguide 116 associated with the temperature measurement 1102 and/or strain/deformation measurement 1104 may not be the same as the location of the component 114 of interest. In such cases, certain embodiments described herein may perform an additional calibration to estimate the temperature and/or strain/deformation measurement at the component's location, based on the temperature measurement 1102 and/or strain/deformation measurement 1104. As shown in FIG. 11, for example, the calibration model 1120 may obtain an indication of the temperature measurement 1102, the strain/deformation measurement 1104, and the measurement location 1106.

In certain embodiments, the calibration model 1120 accesses (e.g., from database 134) mappings of temperature at different positions of the optical waveguide 116 to temperature at the location of the given component 114, and uses the mappings to determine the estimated temperature at the component location 1130. Similarly, in certain embodiments, the calibration model 1120 accesses (e.g., from database 134) mappings of strain/deformation at different positions of the optical waveguide 116 to strain/deformation at the location of the given component 114, and uses the mappings to determine the estimated strain/deformation at the component location 1140. The mappings may be determined via measurement tests performed on the electronic assembly prior to deployment of the electronic assembly in the downhole environment, and stored (e.g., in the database 134) for later use by the calibration model 1120.

Alternatively, in certain embodiments, the calibration model 1120 processes the temperature measurement 1102 and/or the strain/deformation measurement 1104 with a model trained to predict the temperature at the location of the given component and/or the strain/deformation at the location of the given component.

Example Operations

Figure 12:
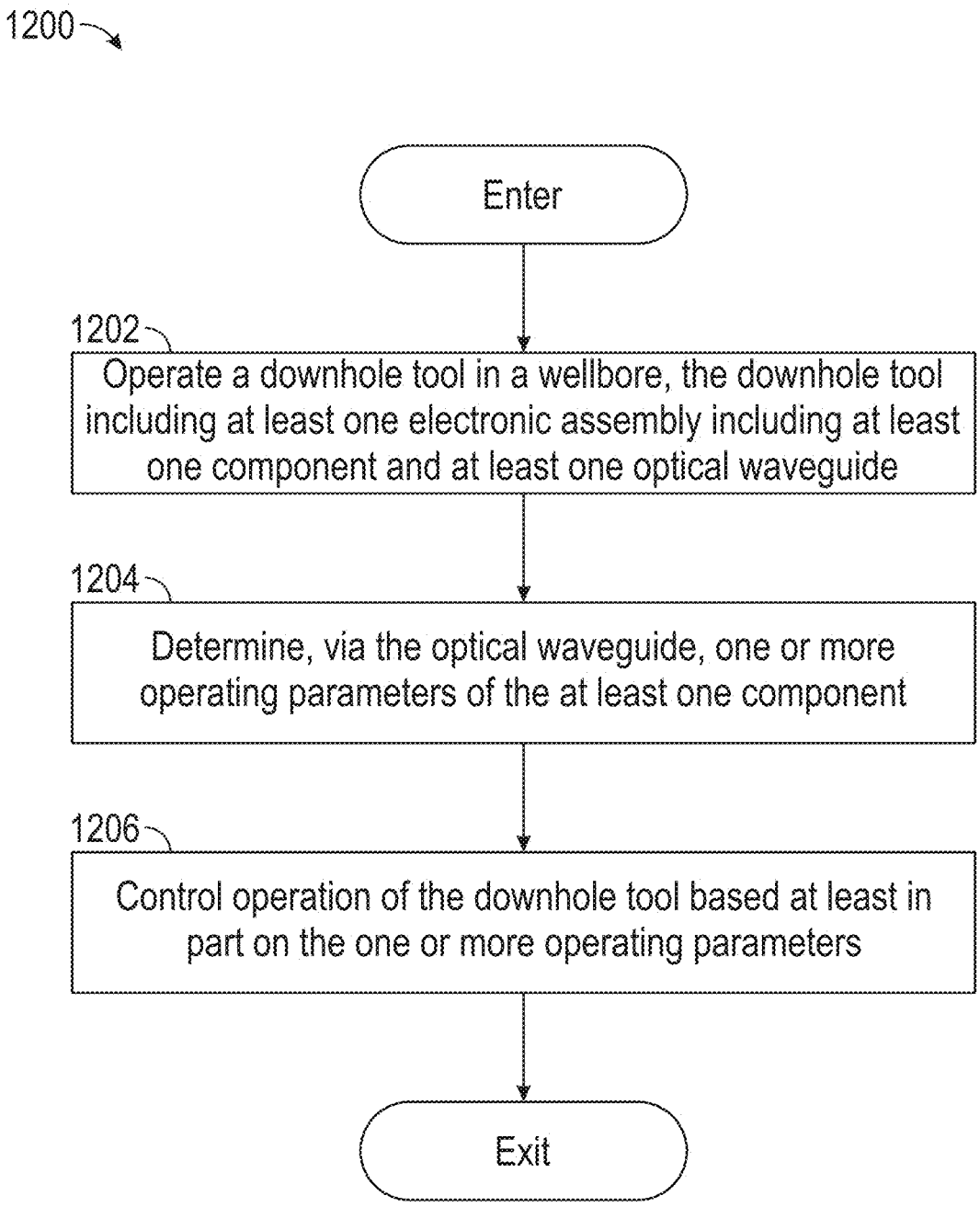
FIG. 12 is a flow diagram depicting example operations, according to certain embodiments.

FIG. 12 is a flow diagram depicting an example operations 1200 for real-time monitoring of an electronic assembly in a downhole environment using an optical waveguide, according to certain embodiments. The operations 1200 may be performed, for example, by a processing system (e.g., processing system 120) or one or more components thereof.

The operations 1200 may involve, at block 1202, operating a downhole tool in a wellbore. The downhole tool may include at least one electronic assembly. The at least one electronic assembly may include at least one component and at least one optical waveguide.

The operations 1200 may also involve, at block 1204, determining, via the optical waveguide, one or more operating parameters of the at least one component.

The operations 1200 may also involve, at block 1206, controlling operation of the downhole tool, based at least in part on the one or more operating parameters.

In certain embodiments, the operations 1200 may further involve: detecting an intensity of an optical signal within the optical waveguide at a first position within the at least one electronic assembly; and determining a first one or more representative operating parameters at the first position, based at least in part on the intensity of the optical signal at the first position.

In certain embodiments, the at least one component may be located at the first position. In some such embodiments, determining the one or more operating parameters of the at least one component may include using the first one or more representative operating parameters as the one or more operating parameters of the at least one component. In certain embodiments, the at least one electronic assembly may further include a substrate, and the first position may include a position on a surface of the substrate. In certain embodiments, the optical waveguide may be routed in a groove disposed on the surface of the substrate.

In certain embodiments, the at least one component may be located at a second position within the at least one electronic assembly. In some such embodiments, determining the one or more operating parameters of the at least one component may include: determining a second one or more representative operating parameters at the second position, based at least in part on the first one or more representative operating parameters; and using the second one or more representative operating parameters as the one or more operating parameters of the at least one component.

In certain embodiments, the at least one electronic assembly may further include a substrate comprising a plurality of layers; the first position may be in a first layer of the plurality of layers; the second position may be in a second layer of the plurality of layers; and the second position may be above the first position.

In some such embodiments, the second one or more representative operating parameters may be determined based on mappings of representative operating parameters at positions of the optical waveguide within the at least one electronic assembly to the second one or more representative operating parameters at the second position of the at least one component.

In some other such embodiments, the second one or more representative operating parameters may be determined based on evaluating the first one or more representative operating parameters with a model trained to predict the operating parameters of the at least one component for representative operating parameters at different positions within the at least one electronic assembly.

In certain embodiments, the optical waveguide may include an optical fiber, a substrate of the at least one electronic assembly, or a photonics integrated circuit (PIC).

In certain embodiments, the operating parameters may include at least one of a temperature of the at least one component, a strain of the at least one component, or a deformation of the at least one component.

In certain embodiments, the at least one electronic assembly may include at least one PCBA, at least one MCM, or a combination thereof.

In certain embodiments, the at least one component may include at least one of an IC, a passive electronic component, an active electronic component, or an interconnect.

In certain embodiments, controlling the operation of the downhole may involve triggering an adjustment in an operating mode of the at least one component, an adjustment in power dissipation of the at least one component, an adjustment in a speed of the downhole tool, or a combination thereof.

Example Clauses

Implementation examples are described in the following numbered clauses:

Clause 1: An electronic assembly comprising: at least one component; at least one optical waveguide; and a controller configured to determine, via the at least one optical waveguide, one or more operating parameters of the at least one component.

Clause 2: The electronic assembly of Clause 1, wherein the electronic assembly comprises a printed circuit board assembly or a multi-chip module.

Clause 3: The electronic assembly according to any of Clauses 1-2, wherein the at least one component comprises at least one of an integrated circuit, a passive electronic component, an active electronic component, or an interconnect.

Clause 4: The electronic assembly according to any of Clauses 1-3, wherein the controller is further configured to: detect an intensity of an optical signal within the optical waveguide at a first position within the electronic assembly; and determine a first one or more representative operating parameters at the first position, based at least in part on the intensity of the optical signal at the first position.

Clause 5: The electronic assembly of Clause 4, wherein: the at least one component is located at the first position; and to determine the one or more operating parameters of the at least one component, the controller is configured to use the first one or more representative operating parameters as the one or more operating parameters of the at least one component.

Clause 6: The electronic assembly according to any of Clauses 4-5, wherein: the electronic assembly further comprises a substrate; and the first position comprises a position on a surface of the substrate.

Clause 7: The electronic assembly of Clause 6, wherein the optical waveguide is routed in a groove disposed on the surface of the substrate or is inserted in a middle layer of a stack of layers of the substrate.

Clause 8: The electronic assembly of Clause 4, wherein: the at least one component is located at a second position within the electronic assembly; and to determine the one or more operating parameters of the at least one component, the controller is configured to: determine a second one or more representative operating parameters at the second position, based at least in part on the first one or more representative operating parameters; and use the second one or more representative operating parameters as the one or more operating parameters of the at least one component.

Clause 9: The electronic assembly of Clause 8, wherein the second one or more representative operating parameters are determined based on mappings of representative operating parameters at positions of the optical waveguide within the electronic assembly to the second one or more representative operating parameters at the second position of the at least one component.

Clause 10: The electronic assembly of Clause 8, wherein to determine the second one or more representative operating parameters, the controller is configured to evaluate the first one or more representative operating parameters with a model trained to predict the second one or more representative operating parameters of the at least one component for representative operating parameters at different positions within the electronic assembly.

Clause 11: The electronic assembly according to any of Clauses 8-10, wherein: the electronic assembly further comprises a substrate comprising a plurality of layers; the first position is in a first layer of the plurality of layers; the second position is in a second layer of the plurality of layers; and the second position is above the first position.

Clause 12: The electronic assembly according to any of Clauses 1-11, wherein the optical waveguide comprises an optical fiber, a substrate of the electronic assembly, or a photonics integrated circuit (PIC).

Clause 13: The electronic assembly according to any of Clauses 1-12, wherein the one or more operating parameters comprise at least one of a temperature of the at least one component, a strain of the at least one component, or a deformation of the at least one component.

Clause 14: A system comprising: at least one electronic assembly comprising at least one component and at least one optical waveguide; and a controller configured to determine, via the at least one optical waveguide, one or more operating parameters of the at least one component.

Clause 15: The system of Clause 14, wherein: the at least one electronic assembly comprises at least one printed circuit board assembly, at least one multi-chip module, or a combination thereof; and the at least one component comprises at least one of an integrated circuit, a passive electronic component, an active electronic component, or an interconnect.

Clause 16: The system according to any of Clauses 14-15, wherein the at least one electronic assembly is located in a downhole environment.

Clause 17: The system according to any of Clauses 14-16, wherein the controller is configured to: detect an intensity of an optical signal within the optical waveguide at a first position within the at least one electronic assembly; and determine a first one or more representative operating parameters at the first position, based at least in part on the intensity of the optical signal at the first position.

Clause 18: The system of Clause 17, wherein: the at least one component is located at the first position; and to determine the one or more operating parameters of the at least one component, the controller is configured to use the first one or more representative operating parameters as the one or more operating parameters of the at least one component.

Clause 19: The system of Clause 17, wherein: the at least one component is located at a second position within the at least one electronic assembly; and to determine the one or more operating parameters of the at least one component, the controller is configured to: determine a second one or more representative operating parameters at the second position, based at least in part on the first one or more representative operating parameters; and use the second one or more representative operating parameters as the one or more operating parameters of the at least one component.

Clause 20: A system comprising the electronic assembly according to any of Clauses 1-13.

Clause 21: A method comprising: monitoring operation of at least one electronic assembly comprising at least one component and at least one optical waveguide; and determining, via the optical waveguide, one or more operating parameters of the at least one component.

ADDITIONAL CONSIDERATIONS

The preceding description is provided to enable any person skilled in the art to practice the various aspects described herein. The examples discussed herein are not limiting of the scope, applicability, or aspects set forth in the claims. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

The various illustrative logical blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, a system on a chip (SoC), or any other such configuration.

As used herein, a phrase referring to "at least one of" a list of items refers to any combination of those items, including single members. As an example, "at least one of: a, b, or c"

is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, "a processor," "at least one processor," or "one or more processors" generally refer to a single processor configured to perform one or multiple operations or multiple processors configured to collectively perform one or more operations. In the case of multiple processors, performance of the one or more operations could be divided amongst different processors, though one processor may perform multiple operations, and multiple processors could collectively perform a single operation. Similarly, "a memory," "at least one memory," or "one or more memories" generally refer to a single memory configured to store data and/or instructions or multiple memories configured to collectively store data and/or instructions.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions. The means may include various hardware and/or software component(s) and/or module(s), including, but not limited to a circuit, an ASIC, or processor.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

The invention claimed is:

1. An electronic assembly comprising:

at least one component;

at least one optical waveguide;

a substrate; and a controller configured to;

detect an intensity of an optical signal within the at least one optical waveguide at a first position within the electronic assembly, wherein the at least one component is located at the first position, wherein the first position comprises a position on a surface of the substrate, and wherein the at least one optical waveguide is routed in a groove disposed on the surface of the substrate or is inserted in a middle layer of a stack of layers of the substrate;

determine a first one or more representative operating parameters at the first position based at least in part on the intensity of the optical signal at the first position; and determine, via the at least one optical waveguide, one or more operating parameters of the at least one component by using the first one or more representative operating parameters as the one or more operating parameters of the at least one component.

2. The electronic assembly of claim 1, wherein the electronic assembly comprises a printed circuit board assembly or a multi-chip module.

3. The electronic assembly of claim 1, wherein the at least one component comprises at least one of an integrated circuit, a passive electronic component, an active electronic component, or an interconnect.

4. The electronic assembly of claim 1, wherein the at least one optical waveguide comprises an optical fiber or a photonics integrated circuit (PIC).

5. The electronic assembly of claim 1, wherein the one or more operating parameters comprise at least one of a temperature of the at least one component, a strain of the at least one component, or a deformation of the at least one component.

6. A system comprising:

at least one electronic assembly comprising at least one component and at least one optical waveguide; and a controller configured to;

detect an intensity of an optical signal within the at least one optical waveguide at a first position within the at least one electronic assembly, wherein the at least one component is located at a second position within the at least one electronic assembly;

determine a first one or more representative operating parameters at the first position based at least in part on the intensity of the optical signal at the first position; and determine, via the at least one optical waveguide, one or more operating parameters of the at least one component by:

determining a second one or more representative operating parameters at the second position based at least in part on the first one or more representative operating parameters; and using the second one or more representative operating parameters as the one or more operating parameters of the at least one component.

7. The system of claim 6, wherein:

the at least one electronic assembly comprises at least one printed circuit board assembly, at least one multi-chip module, or a combination thereof; and the at least one component comprises at least one of an integrated circuit, a passive electronic component, an active electronic component, or an interconnect.

8. The system of claim 6, wherein the at least one electronic assembly is located in a downhole environment.

9. The system of claim 6, wherein the at least one optical waveguide comprises an optical fiber, a substrate of the electronic assembly, or a photonics integrated circuit (PIC).

10. The system of claim 6, wherein the one or more operating parameters comprise at least one of a temperature of the at least one component, a strain of the at least one component, or a deformation of the at least one component.

11. A method comprising:

monitoring operation of at least one electronic assembly comprising at least one component, a substrate, and at least one optical waveguide;

detecting an intensity of an optical signal within the at least one optical waveguide at a first position within the electronic assembly, wherein the at least one component is located at the first position, wherein the first position comprises a position on a surface of the substrate, and wherein the at least one optical waveguide is routed in a groove disposed on the surface of the substrate or is inserted in a middle layer of a stack of layers of the substrate;

determining a first one or more representative operating parameters at the first position based at least in part on the intensity of the optical signal at the first position; and determining, via the at least one optical waveguide, one or more operating parameters of the at least one component by using the first one or more representative operating parameters as the one or more operating parameters of the at least one component.

12. The method of claim 11, wherein the electronic assembly comprises a printed circuit board assembly or a multi-chip module.

13. The method of claim 11, wherein the at least one component comprises at least one of an integrated circuit, a passive electronic component, an active electronic component, or an interconnect.

14. The method of claim 11, wherein the at least one optical waveguide comprises an optical fiber or a photonics integrated circuit (PIC).

15. The method of claim 11, wherein the one or more operating parameters comprise at least one of a temperature of the at least one component, a strain of the at least one component, or a deformation of the at least one component.

16. The method of claim 11, wherein the at least one electronic assembly is located in a downhole environment.

* * * * *